United States Patent [19]

Windisch et al.

[11] Patent Number: 4,778,979

[45] Date of Patent: Oct. 18, 1988

[54] ELECTRICAL SURFACE HEATING ELEMENT AND PROCESS FOR PRODUCING SAME

[76] Inventors: Sigrid Windisch; Josef G. Windisch, both of Langefelderstrasse 14, A-8793 Trofaiach, Austria

[21] Appl. No.: 67,772

[22] PCT Filed: Oct. 10, 1986

[86] PCT No.: PCT/AT86/00064

§ 371 Date: Jun. 10, 1987

§ 102(e) Date: Jun. 10, 1987

[87] PCT Pub. No.: WO87/02540

PCT Pub. Date: Apr. 23, 1987

[30] Foreign Application Priority Data

Oct. 11, 1985 [AT] Austria ..... A2950/85
Oct. 11, 1985 [AT] Austria ..... A2951/85
Oct. 11, 1985 [AT] Austria ..... A2952/85

[51] Int. Cl.[4] ..... H05B 3/10

[52] U.S. Cl. ..... 219/548; 219/345; 165/168

[58] Field of Search ..... 219/345, 548, 346, 347, 219/350–351; 165/168–172

[56] References Cited

U.S. PATENT DOCUMENTS 2,521,540 9/1950 Richardson ..... 219/345
3,400,247 9/1968 Deacon ..... 219/345
3,935,422 1/1976 Barnes et al. ..... 219/345 X
4,438,325 3/1984 Gellert ..... 219/548

FOREIGN PATENT DOCUMENTS 310891 10/1973 Austria .
313432 2/1974 Austria .
150448 8/1985 European Pat. Off. .
878992 6/1953 Fed. Rep. of Germany .
1908734 9/1970 Fed. Rep. of Germany .
2353395 5/1975 Fed. Rep. of Germany .
8327219 12/1983 Fed. Rep. of Germany .
3300891 7/1984 Fed. Rep. of Germany .

*Primary Examiner*—E. A. Goldberg
*Assistant Examiner*—M. M. Lateef
*Attorney, Agent, or Firm*—Salter & Michaelson

[57] ABSTRACT

In an electrical surface heating element, there are conductors (10) embedded within a panel (1) of electrically insulating material, which conductors are connected to supply conductors or, respectively, to the heating conductors of the surface heating element, and enter cavities (7) of the panel (1) open to the panel edge (6), within which cavities the electrical connecting points for connecting adjacent panels (1) are located. Each cavity (7) is constricted in direction towards the panel edge (6) and can be closed above by at least one removable cover (15,16), so that the connecting points of the conductors (10) are accessible also after having installed the panels (1).

32 Claims, 6 Drawing Sheets

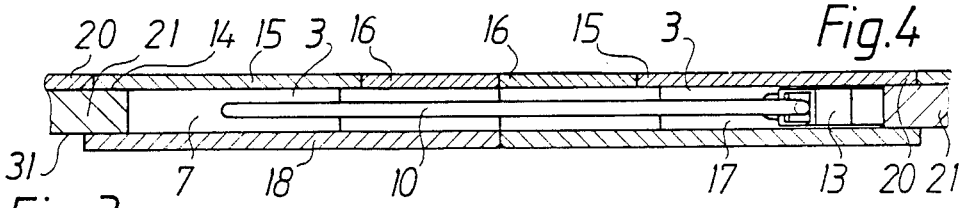
Fig.4
Fig.3
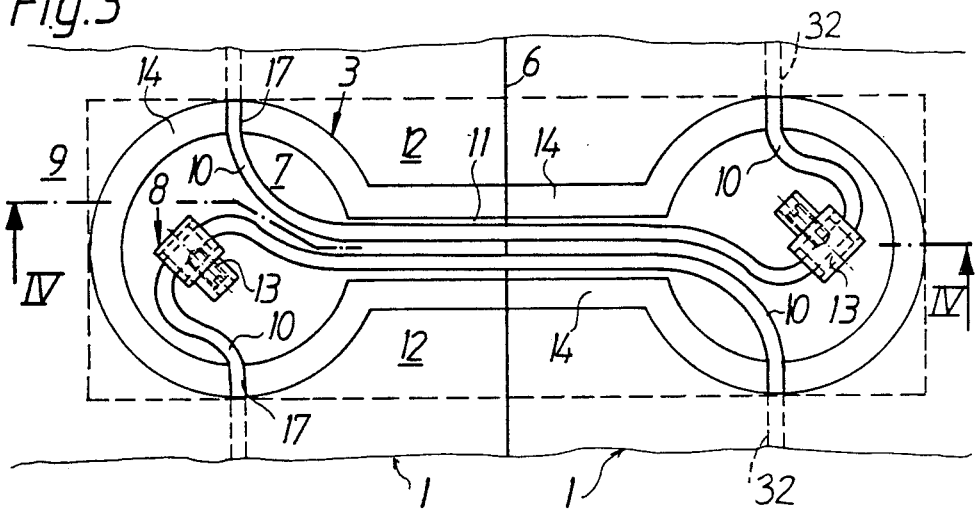
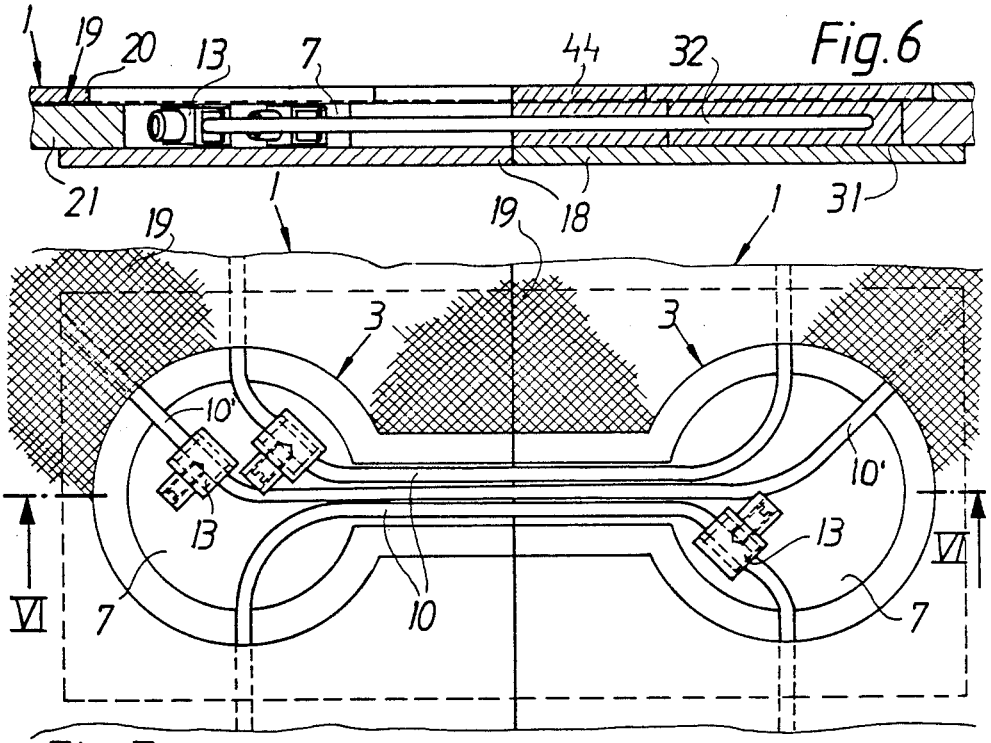
Fig.6
Fig.5

FIG.11
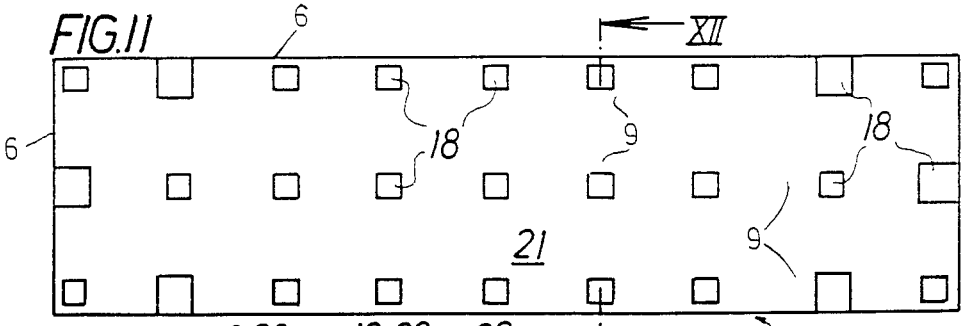
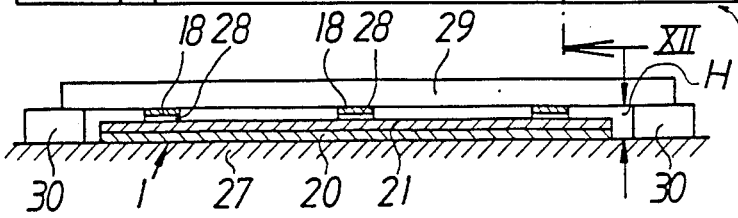
FIG.12
FIG.14
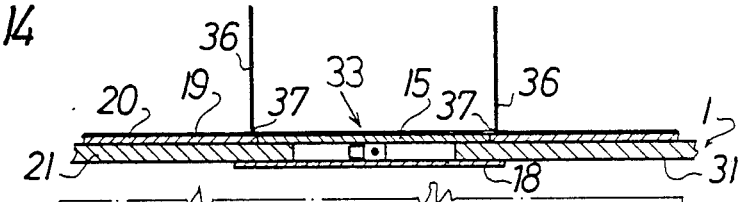
FIG.13
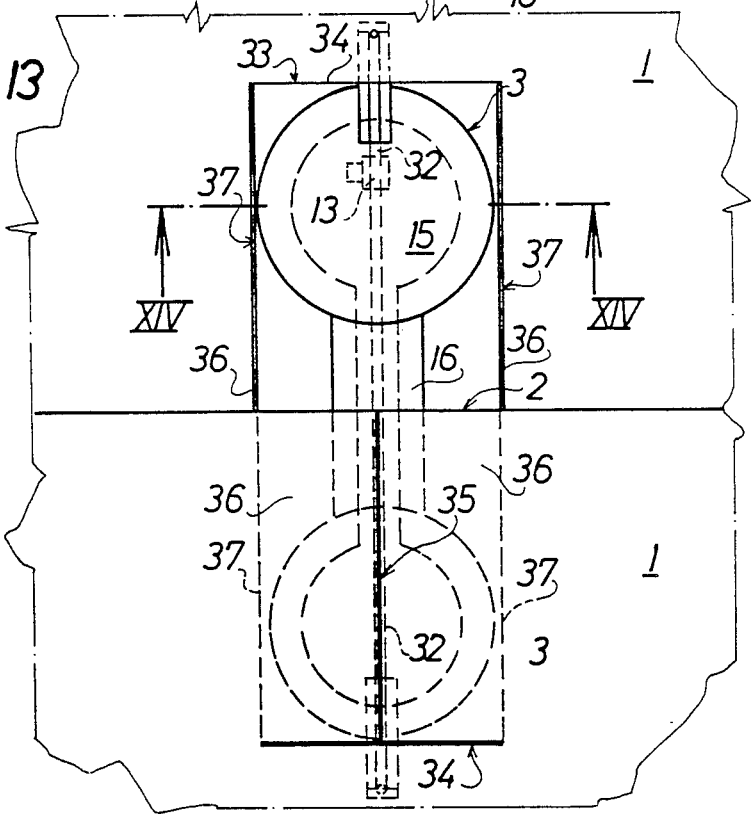

ELECTRICAL SURFACE HEATING ELEMENT AND PROCESS FOR PRODUCING SAME

The invention refers to an electrical surface heating element having the shape of a panel of electrically insulating material, in particular synthetic plastics material, and having embedded therein heating conductors being connected to supply conductors which enter at least one cavity of the panel, which cavity is open to the edge of the panel and acommodates electrical connecting points of the supply conductors of adjacent panels, this cavity, when seen onto the panel from above, has a constriction in the marginal area of the panel, in which constriction the supply conductors are disposed.

The invention further refers to a process for producing such a surface heating element.

For the purpose of electrically connecting adjacent panelshaped surface heating elements it is known to interconnect the heating conductors of adjacent elements by means of plug connections (German utility model specification No. 8 327 219). This results in the drawback that, on the one hand, the panels must exactly be aligned one relative to the other when installing adjacent panels and that, on the other hand, there is the risk of bare electrically life points remaining within the area of the gap between two adjacent panels. Thus, it has already become known (Austrian patent specification No. 313,432) to provide a recess in the panel edge which recess has, as seen in a top plan view, a rectangular shape, the heating conductors extending into said recess. The recesses of two adjacent panels are located one opposite to other and form a cavity accommodating the connecting points of the heating conductors, this cavity together with the gap between said both panels, being filled up with a sealing compound adhering on the panels. In this manner it is possible to avoid the drawbacks of the previously described known construction, however, the rectangular recesses extending with their longitudinal dimension in parallel relation to the panel edge have the disadvantage of forming a comparatively long interruption of the panel edge, via which humidity may enter the interior of the panel. Furthermore, in general there exists no possibility to install adjacent panels such, that they directly contact one another.

In a further known electrical surface heating element of the kind described (German patent specification No. 878,992) a dove-tail recess is provided in centrally located wooden layers of a panel composed of a plurality of wood layers, the heating conductors extending into this recess. This recess is, however, covered on bottom and on top by the outermost wood layers. Thus, it becomes difficult to make the electrical connection when installing adjacent panels without any gaps therebetween. As soon as the panels have been installed and have been fixed to the supporting base, for example a floor finish, a non-destructive access to the electrical connecting points is not possible.

It is an object of the invention to improve an electrical surface heating element of the initially mentioned type such that installation of adjacent panels is possible in a more versatile manner and, above all, also in direct contact one with the other, or without any gap between two adjacent panels, and that the connecting point is well protected against the access of humidity and, above all, the connecting points are permanently accessible after installation of the panels. In this connection, the construction shall be such that the installed panels can immediately be walked on, without the risk of stumbling due to any uneveness of the surface of the installed panels. According to the invention, this task is—based on an electrical surface heating element of the initially described type—solved by the fact that the cavity extends upwardly up to the top surface of the panel also within the area of the constriction and is closed to above by a filling compound and/or at least one removable cover extending to the panel edge and covering the connecting point, the top surface of the filling compound or of the cover smoothly adjoining the top surface of the adjacent panel area. This results in a number of advantages: Primarily, the electrical connecting point for two adjacent elements is not located immediately at the panel edge, but is inwardly displaced to some degree and away from the area of the junction gap. This provides the possibility to install the surface heating elements without any gap therebetween and without giving rise to difficulties at the connection points. The constriction of the cavity in direction towards the panel edge results in a better shielding of the electrical connecting points arranged within the cavity against the access of humidity, for example in form of spray water or condensate, but also in a better protection against mechanical stress, for example tension forces or impact forces, exerted when installing the panels. Simultaneously, the constriction of this cavity provides a good hold for filling compound or sealing compound, respectively, by means of which the remaining hollow space at the connecting area may be filled after having made the electrical connections. Even if this compound has no or an only poor adherence on the material of the panel, this compound can not be moved along the plane of the panel. Above all, introduction of this compound is facilitated because this compound can, optionally after having removed the cover, easily be introduced from above and the connecting point is at any time and also repeatedly freely accessible. On account of this fact, the electrical connection of adjacent panels can be checked and optionally also be changed at any time without damaging the surface heating elements. Because the cover or the compound, respectively, is flush with the plane of the panel, the surface heating elements can also be installed on already existing floors and can be immediately walked on, but it is also possible to install the surface heating elements into the floor construction in the manner usual till now, for example into a floor finish.

According to a further development of the invention, the cavity is enlarged in direction to the top surface of the panel in a step-like manner, a horizontal limiting surface of this step forming an abutment for the cover. This cover can be cut out of the material of the panel when making the cavity, but can also be separately produced. In any case, the cover forms, when bein placed in position, a shield for the connecting joint, so that a sealing compound filling the cavity does not need to extend up to the top surface of the panels. If the cover consists of the material of the cover layer of the panel, the connecting joint is scarcely visible when the cover is placed in position, which substantially contributes to make the inventive electrical surface heating elements suitable for being immediately walked on, that means to make the heating elements suitable for being used without any layers covering the panels. It is only for optical reasons that a braced carpet or a floor cover of synthetic plastics material is placed onto the panels, but such a floor cover would not be required for technical reasons.

It is within the scope of the invention, that the cavity has, as seen in a top plan view onto the panel, a circular portion being in connection with the panel edge via a connecting channel being delimited by two oppositely salient protrusions forming the constriction, the mutual distance of said both protrusions from one another being smaller than the diameter of the circle, the circular portion and the connecting channel being closed to above by separate covers. The circular shape of the cavity portion enables one to produce this portion out of the panel by material detaching work by a boring operation, whereupon the connecting channel can also easily be cut out of the panel. In this case it is convenient to provide for recesses, in particular in slot like form accommodating the ends of the supply conductors and laterally extending from said circular portion of the cavity and being open in direction to the enlargement. The supply conductors can be put into these recesses, so that they do not become damaged when making the cavity.

For the purpose of closing the cavity also on its bottom side, for example for the purpose of avoiding a flow out of the cavity of the sealing compound used at the connecting joint, the cavity can be closed at the bottom side by a supporting member provided on the bottom surface of the panel, for example by a plate fixed to the bottom surface of the panel. There may be arranged a plurality of such rigid supporting members which are stationary relative to the bottom surface of the panel and confine together with the bottom surface of the panel, a net of interconnected air channels located below the bottom surface of the panel, such channels extending between the supporting members, at least some of said air channels leading to the panel edge. Thus, any heat accummulation below the panel is avoided and the whole heated surface is more uniformely supplied with heat energy. These air channels may also be used for supplying the heated air to the margins of that area having installed thereon the surface heating elements, in particular for supplying the heated air to walls delimiting said surface area, so that a heating effect results also at this location by the rising air.

For the purpose of fixing the electrical energy supply cable in a tension-resistent and torsion-resistent manner, there may be according to the invention, a cross-piece provided within the cavity, which cross piece is preferably provided with guiding grooves for wires, this cross-piece being supported with its both ends on the protrusions and having wound thereon a current supply conductor leading to the supply conductors of the panel. This results in a reliable relief from tension forces for this current supply cable. The cross-piece can be an elongated plate placed in flat position within the cavity and having guiding grooves obliquely extending relative to the longitudinal axis of said plate, so that the cross-piece can be housed without the cavity without any problems.

In case of surface heating elements of the type having on their surface an electrically conducive layer, particularly a thin foil or a net, extending over the whole surface area of the panel and being adapted for being connected at at least one connecting point with the same layer of the adjacent panel, according to a further development of the invention, the electrically conductive layer may have, above the connecting point, at least one flap being adapted for being swung out from a position covering the connecting joint into a position clearing the connecting joint. The connecting joint is conveniently housed within the mentioned cavity, but this is not imparative for the arrangement of flaps mentioned above. In this manner, it becomes possible to unobjectionably interconnect the electrically conductive layers of the panels without detracting from the smoothness of the surface. There results a continuous electrically conductive layer without any substantial unevenness even at the connecting point, so that this layer can fulfill the intended purpose without any restriction also at the connecting points. This is frequently desired for special purposes, for example at locations where such an electrically conductive layer serves for forming a grounding or a shielding or the like, for example layers for the conductive discharge in computer rooms and so on. When making the electrical connection of the electically conductive layers of adjacent panels, it is only necessary to make the connecting points accessible by upwardly swivelling the flaps, whereupon, after having finished the manipulations required for making the electrical connection, the flaps are again swung back. It would be conceivable to position the flaps at some distance from the panel edge if channels or conduits leading to the connecting point are prefabricated within the panel. However, it is, according to the invention, more favourable if the flap extends to the edge of the panel, because in this manner the wiring or the like serving for the purpose of electrically connecting adjacent panels, is equally covered by the flap and can thus be mounted or disassembled, respectively, without problems when upwardly swinging the flap.

According to a particularly simple embodiment of the invention, the flap is limited by two incisions in the electrically conductive layer, said incisions extending from the edge of the panel and extending preferably in parallel relation one to the other. The flap forms then a tongue extending from the edge of the panel, which tongue may even be rolled up, if the material of the flap allows this.

The inventive process for producing a surface heating element according to the invention, consists in that at the connecting point an opening is made, preferably bored, in the cover layer prior to connecting same to the underlying layer, that then a layer is applied to said cover layer at the area of its opening and at its bottom side, said layer having an opening being smaller than the opening of the cover layer and being in connection with the last-named opening, within the protruding edge of said smaller opening being provided at least two mutually staggered cutouts, in that the heating conductors and the supply conductors are applied to the bottom side of the latter layer, the ends of the supply conductors and of conductor pieces connected thereto, respectively, located within the cutouts and extending into the cavity, into which these ends are finally introduced, preferably in a rolled-up condition, and in that, optionally after having filled the remaining cavity with a material not adhering to the heating conductors and to the adjacent layers and, respectively, or after having applied to cover closing the opening of the cover layer, there is applied a layer covering the conductors at the bottom side and being, if necessary, subjected to a boring operation within the area of the opening. In this manner, it is possible to later work the cavity accommodating the connecting point of the supply conduits out of the layer without damaging the supply conduits.

A further development of the process according to the invention may be used with advantage in connection with a panel having a plurality of supporting members arranged spaced apart from each other and distributed over the bottom surface of the panel, wherein with such a panel, the supporting members, in particular plates, are glued at a mutual distance one from the other to the bottom surface of the panel, noting that a plurality of these supporting members are made flush within a plane by pressing a plane ruler against these supporting members and by compressing the tacky layer prior to its solidification, said supporting members being rigidly and immovably connected with the panel after solidification of the tacky layer. In this manner, an additional advantage can be obtained, which consists in an equalization of the frequently uneven lower bottom surface of the heating element, particularly if the body of the heating element consists of synthetic plastics material being reinforced with glass fibres. In this manner it can be achieved that the thickness of the surface heating element, as measured through the supporting members, is the same at all locations. This results in the advantage, that, when installing the heating elements in mutually close contact on a plane supporting base, no steps whatsoever are formed at the top surface of the heating element.

In the drawings, the subject of the invention is schematically illustrated with reference to embodiments.

FIG. 3 is a top plan view of the connecting points of the heating conductors of adjacent surface heating elements in a greater scale, the covers for these connecting joints being removed.

FIG. 4 shows a section taken along the line IV—IV of FIG. 3, with the covers being in position.

FIG. 5 shows a modified embodiment of the embodiment according to FIG. 3 and FIG. 6 shows a section taken along the line VI—VI of FIG. 5.

FIG. 11 shows a view of a modified embodiment of the heating element from its bottom side.

FIG. 12 shows in an enlarged scale a section taken along line XII—XII of FIG. 11 during manufacturing the surface heating element.

FIG. 13 shows a detail in a top plan view.

FIG. 14 is a section taken along the line XIV—XIV of FIG. 13.

Figure 18:
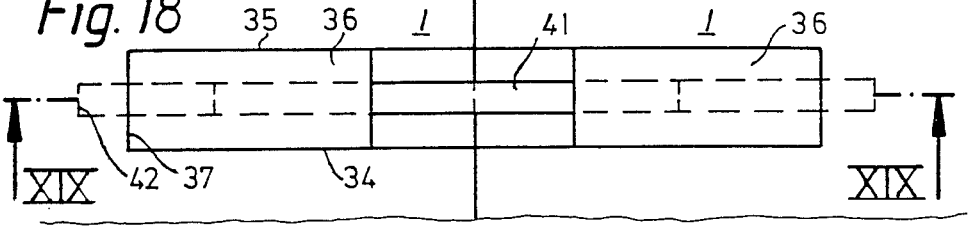
Figure 20:
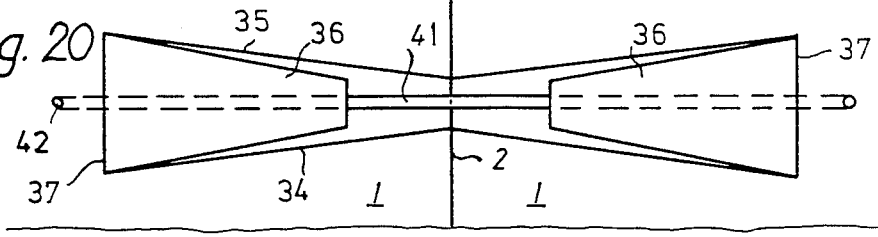
Figure 21:
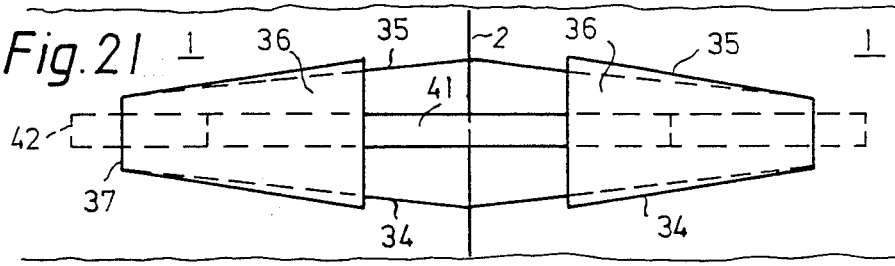

FIGS. 20 and 21 each show a modification of the embodiment according to FIG. 18.

Figure 1:
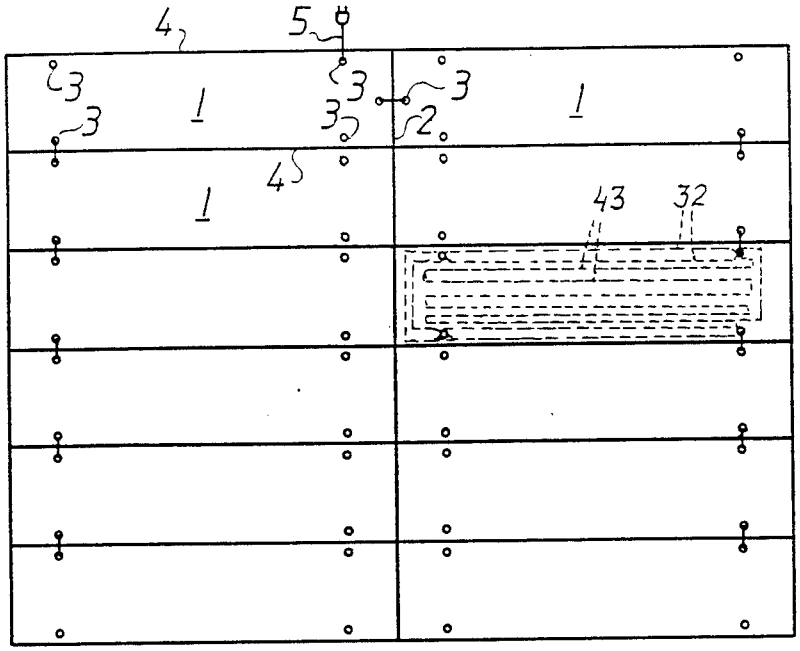
FIG. 1 shows a top plan view of an electrical floor heating arrangement consisting of a plurality of surface heating elements installed in direct contact one with the other.
Figure 2:
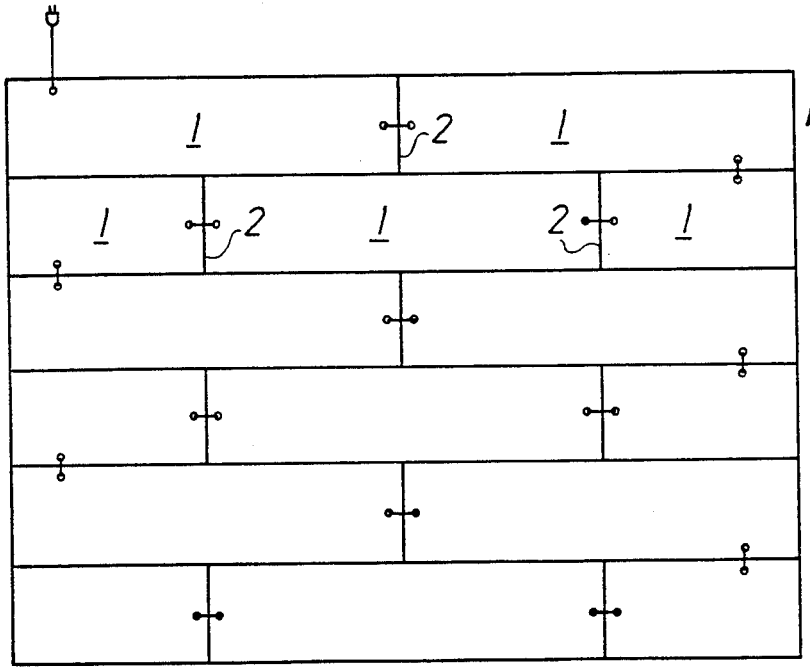
FIG. 2 shows a modified embodiment of the embodiment according to FIG. 1.

In FIGS. 1 and 2, there are shown two examples of embodiments of an electrical floor heating arrangement in a top plan view, a plurality of surface heating elements having the shape of panels 1 or plates being installed in direct contact one with the other. In the embodiment according to FIG. 1, all of these panels 1 have the same size, whereas in the embodiment according to FIG. 2 large panels are alternately arranged together with small panels in each second row, so that the junction gaps 2, where the small sides of the rectangular panels 1 contact one another, are mutually staggered in the individual rows. In the embodiment according to FIG. 1, each panel 1 has four openings 3 for accommodating the connecting points between the supply conductors 32 and the heating conductors 43, which may be disposed within the panels 1 at any desired number and in any arrangement, for example according to a meander line. A pair of openings 3 is located at each longitudinal edge 4 of the panel 1, but at a small distance therefrom. Panels 1 of a column and mutually contacting each other are connected to each other via two adjacent openings 3. In addition thereto, the two first panels 1 of each column show openings 3 at the small edges, that are the edges of the panels 1 forming the junction gaps 2, via which openings the supply conduits of these both panels 1 are connected to each other, so that electrical energy is supplied to the panels 1 of both columns. One of the panels 1 has an electric energy supply cable 5, the wires of which are connected with the supply conductors in one of the openings 3, as will be described later in more detail. In FIG. 1, there is shown in dashed lines for one of the panels 1 an example for placing the supply conductors 32 as well as of a meander-like heating conductor 43. The supply conductors 32 extend along the panel edge from recess 3 to recess 3 and enter the recesses 3 with conductor pieces connected to the supply conductors 32. The individual heating conductors 43 are connected to the supply conductors 32 within the panel 1, so that the heating conductors 43 of all panels 1 are connected in parallel to the net of supply conductors 32. Thereby, any voltage drop or ununiform temperature rises, respectively, of individual panels 1 is avoided.

The same type of connection of the heating conductors of adjacent surface heating elements is, in principle, also present in the embodiment according to FIG. 2, in which, however, the connection of adjacent panels 1 extends along a meander line over the whole heated surface area.

In the FIGS. 3 and 4, there is shown a connecting area in detail and in a larger scale. Each of both panels 1 to be connected to each other has an opening 3 being open in direction to the panel edge 6 and forming a cavity 7 which narrows in direction towards the panel edge 6 and accommodates the connecting points 8 of the conductor pieces 10 leading to the supply conductors 32 of adjacent panels. The cavity 7 has a circular portion being in connection with the panel edge 6 by a connecting channel 11 accommodating the conductors 10. This connecting channel 11 is confined by two protrusions 12 located at the area of the panel edge 6 and being salient one relative to the other, the distance of both protrusions 12 from each other being smaller than the diameter of the circle forming the circular cavity, so that the opening 3 is constricted in direction to the panel edge 6. This contributes that humidity encounters at the panel edge 6 an only very small area of attack, through which this humidity might reach the electrical connecting point. The conductor pieces 10 entering the cavity 7 are connected there with the conductors of the other panel by usual connecting elements 13, for example screw terminals, crimping joints, soldering sockets, plug connections and so on. The conductor pieces 10 coming from the respective other panel 1 can, when making the connection, easily be inserted from top into the connecting channel 11, because this connecting channel 11 is, like the circular portion of the cavity 7, open to the top surface of the panel. Due to the fact that the cavities 7 extend over the whole depth of the panel, as measured in normal direction to the plane of the panel, there is sufficient space at disposal within the cavity 7 for accommodating the connecting elements 13. In case of multiwire connecting points, the connecting elements 13 of the individual wires can, as is shown in FIG. 3, be distributed over both openings 3, in order to provide more space. Thus, the panels 1 can be very thin and can be directly installed on the base floor as a floor heating equipment which can be walked upon.

The cavity 7 and the connecting channel 11 extend in upward direction in a step-like manner into enlargements 14, which serve a double purpose: On the one hand, this enlargement 14 forms a horizontal step for at least one cover covering the connecting point. The cover 15 for the circular portion of the cavity has a circular shape, whereas the cover 16 for the connecting channel 11 has a substantially rectangular shape, however, it is delimited at one side by an arc of a circle in correspondence to the circular shape of the adjacent cover. The other purpose of the enlargement 14 is to provide therein recesses 17 formed of lateral slots which open towards the cavity 7, the conductor pieces 10 being inserted into these recesses 17. This provides the possibility to produce the cavity 7 by a boring operation without damaging the conductors 10, which will later be explained in more detail. After having made the electrical connections, the cavity 7 as well as the connecting channel 11 can be completely filled by a casting operation with a filling compound 44 adhering to the material of the panel 1 (FIG. 6, right-hand cavity 7), which results in a completely humidity-tight shielding of the connecting points of the conductors 10. The filling compound 44 may, however, also spare a space for the covers 15, 16. Then, with the covers 15, 16 placed in position, this casting compound is no more visible. In all cases a plane surface of the surface heating element 1 is achieved. For preventing the casting mass from flowing out at the bottom side of the cavity 7 or of the connecting channel 11, respectively, the cavity 7 and the connecting channel 11 are closed at the bottom side by a supporting member 18 extending from the panel 1 in downward direction and having the shape of a plate glued to the panel 1. Simultaneously this provides the possibility to balance the height of the surface heating element.

FIGS. 5 and 6 show, in a view and in a section similar to that of the FIGS. 3 and 4, an embodiment comprising a metallic net 19 of protective conductors, for example of copper, iron or bronze, which net 19 extends, optionally with exception of the openings 3, over the whole surface area of the panel 1 and is embedded between two layers 20, 21 of the surface heating element 1, the layer 20 forming the cover layer, whereas the conductors 10 are embedded into the underlying layer 21. The protective conductor net 19 is connected to conductor pieces 10' which, in a similar manner as the conductor pieces 10, leading to the supply conductors 32, are conductively connected with each other within the cavities 7 by means of connecting elements 13. Alternatively, instead of such a protective conductor net 19, the insulating mantle of the individual heating conductors 43 (FIG. 1) and of the supply conductors 32, respectively, may be provided with an outer metallic wrapping which is put to ground and forms the protective conductor.

Figure 8:
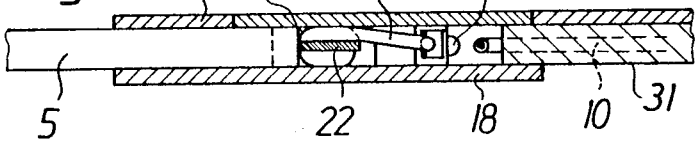
FIG. 8 is a section taken along line VIII—VIII of FIG. 7.
Figure 7:
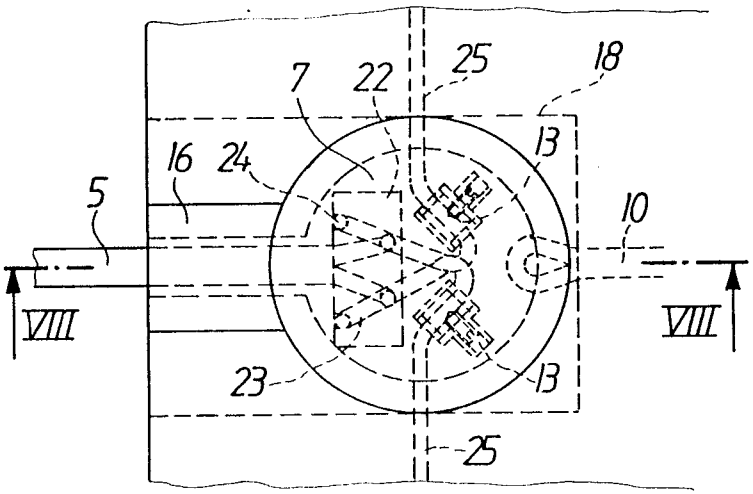
FIG. 7 shows, in a top plane view, a tension relief arrangement.

FIGS. 7 and 8 show a tension relief for the supply cable 5. For this purpose. The cores of the supply cable 5 having the cable mantle removed therefrom are wound around a cross-piece 22 which is a flat elongated plate provided with guiding grooves 23, obliquely extending relative to the longitudinal axis of the plate and guiding the wires 24 of the conductors of the supply cable 5. These wires 24 are connected by means of the connecting elements 13 to conductor pieces leading to the supply conductors 32. The cross-piece 22 abuts with two of its corners on the walls of the cavity 7. The cross-piece 22 is reliably maintained in place by the filling mass, which fills the cavity 7, so that the supply cable 5 is fastened reliably against tension forces and torsion forces.

Figure 10:
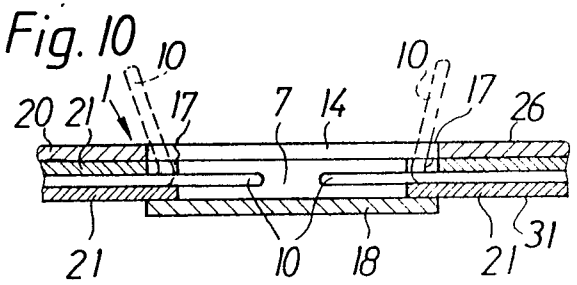
FIG. 10 is a section taken along line X—X of FIG. 9.
Figure 9:
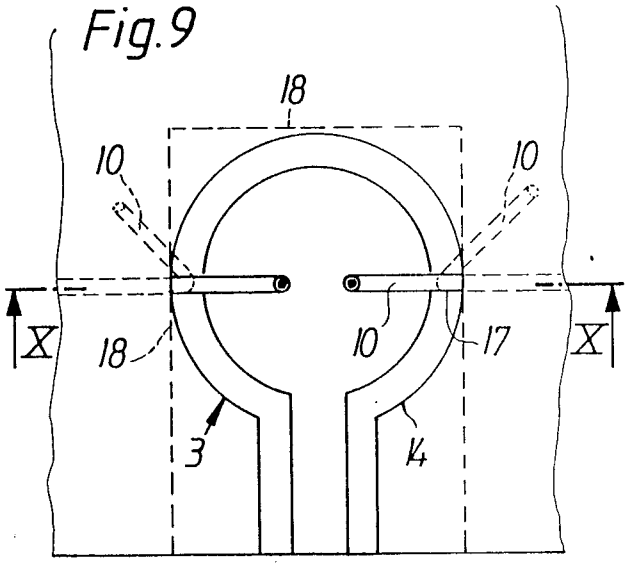
FIG. 9 shows the arrangement of the heating conductors within the cavity of the connection location when forming this cavity.

FIGS. 9 and 10 illustrate a favourable process when making the openings 3. At first, there is made, preferably by boring, an opening corresponding to the size of the enlargement 14 in the layer 20 forming the cover layer prior to connecting said layer to the underlying layer 21. Then, a layer 21 is applied to the bottom of this cover layer 20, which layer 21 is already provided with an opening corresponding to the size of the cavity 7 or such an opening is made at a later opportunity. This opening has recesses 17 having the form of slots and laterally extending away from the cavity 7. The two layers 20, 21 are then so disposed relative to each other and connected with each other that said both openings are coaxially aligned. Subsequently, the conductors 10 are applied to the bottom side of the layer 21 and connected therewith, for example glued to this layer, noting that the ends of the conductors enter the cavity 7 within the recesses 17, the ends of the conductors being put into the cavity with an excessive length required for establishing the electrical connection, preferably being rolled up. Subsequently, the remaining portion of the layer 21 is applied onto the conductors 10 at the bottom side, so that the conductors 10 are embedded within this layer 21. Also this layer may have an already prefabricated opening at the area of the cavity 7, so that in this case the cavity extends over the whole depth of the layer 21. The cavity 7 is preferably closed at the bottom side by a supporting member 18. The free space within the cavity 7 may be filled up to the upper edge of the layer 21 with a material, for example a polyurethane foam, which does not adhere to the adjacent layers 20, 21 and to the conductors 10, said material being selected such, that it can easily be removed, for example scraped out, without thereby damaging the conductors 10. The covers 15, 16 may be glued onto the filling material of the cavity 7. The covers fit exactly into the opening of the layer 20 and rest on the enlargement 14. Such filling of the cavity 7 prevents that the conductors 10 become cemented when producing the surface heating element. The material filling the cavity 7 can be removed later again, so that the conductors 10 are always easily accessible for making any intended electrical connection. Before making the wire connection, the covers 15, 16 are removed. If the cavity 7 is not sufficiently deep for accommodating all connecting elements 13, the lower portion of the layer 21 can be removed by a boring operation. In order to avoid in this case any damage of the ends of the conductors 10, these ends are upwardly bent, so that they extend above the surface of the heating element (shown in dashed lines in FIG. 10). In this case, said conductor ends extend away from the cutouts 17 and thus do not protrude into the space forming the real cavity 7, so that, when effecting the boring operation with some care, said cavity can be made deeper by boring out the remaining thickness of the layer 21, optionally over the total thickness of the layer 21. After this optionally performed increase of the size of the cavity 7, the desired connections of the conductors 10 are made, the remaining space within the cavity 7 is filled up with an insulating casting material and finally, if desired, the cover 15 is again placed in position and firmly glued to the casting material and, respectively, or to the enlargement 14. The supporting member 18 prevents the casting material from downwardly flowing out, also from the connecting channel 11, which channel is subjected to an analogous procedure.

As already mentioned, a plurality of such supporting members, for example having the shape of plates, can be provided on the bottom side of the panel 1, spaced apart from one another, so that the supporting members are not only located within the area of the recesses 3 but also therebetween (FIG. 11). Thereby a system of supporting members for the panel 1 is achieved which forms between the single supporting members a net of mutually interconnected air channels 9, which net counteracts any accumulation of heat on the bottom surface of the panel 1, because at least some of the air channels 9 extend to the panel edge 6, so that the system of air channels 9 extends up to the margin of the surface area heated by the surface heating elements, on which margin the heat generated is carried away. For the purpose of forming air channels 9 of sufficient size, it is convenient if each supporting member has a width which is only a small fraction of the length and the width of the panel 1, preferably the width of the air channel 9, as measured from supporting member 18 to supporting member 18, is greater than the length and the width of a supporting member 18. The plates forming said supporting members can, however, also be utilized for a further purpose, namely for the purpose of compensating any inexactness, if any, of the thickness of the layers 20 and 21, so that—plane base surfaces given—the top surface 26 (FIG. 10) of the panel 1 forming the surface heating element extends exactly along a plane and in a predetermined level, so that adjacent surface heating elements can be adjoined one to the other without any steps. Particularly if glass fibre-reinforced synthetic plastics material, in particular polyester or epoxide, is used, there frequently results during the production of the surface heating element an ununiform thickness which gives rise to the formation of the mentioned steps at the junction point of adjacent elements. The process as illustrated in FIG. 12 for producing the surface heating element 1 avoids such disadvantages: The surface heating element is, after having been produced out of the layers 20, 21, placed onto a plane base 27 with its layer 20 facing downwardly. Subsequently, an abundant and excessively thick adhesive layer 28 is applied to those areas, at which the plates forming the supporting members 18 shall immovably be fixed to the layer 21 and the respective plate is placed onto this adhesive layer 28. The plates, which are conveniently aligned along rows, are then pressed downwardly by placing thereon a plane ruler 29, thereby compressing the respective thick adhesive layer 28 with simultaneous reduction of its oversize, until the ends of the ruler 29 rest on stop members 30 being arranged on the base 27 at both sides of the surface heating element 1 and having a height corresponding to the nominal height of the surface heating element 1 and the supporting members 18 inclusive. After solidification of the adhesive layer 28, the surface heating element 1 is completed and has at all locations of the plates forming the supporting members an exactly predetermined nominal height H (FIG. 12), said nominal height being reproducable for successively manufactured surface heating elements 1 as long as the same stop members 30 are used.

The supporting members 18 need, however, not be separately manufactured and then be connected with the overlying layers of the panel 1, but may also be formed together with the lowermost layer, for example by a deep drawing process.

A further reduction of any heat accummulation below the surface heating element 1 can be obtained if a reflecting foil is arranged on the bottom side of the surface heating element 1. This foil can, for example, consist of aluminium or be formed of a resin layer strongly enriched in aluminium powder.

The embodiment according to the FIGS. 13 and 14 is of advantage in those cases, in which a protective conductor layer shall also completely cover the areas of the connecting points. For this purpose, there is provided an electrically conductive protective conductor layer 19 being formed of a net or of a foil and being, in contrast to the embodiment according to the FIGS. 5 and 6, not located between the two layers 20, 21, but on the top surface of the layer 20. This protective conductor layer 19 has a window 33 within the area of each opening 3 of the surface heating element 1, this window 33 being formed by two slots 34, 35 within the material of the protective conductor layer 19, said slots extending perpendicularly one relative to the other according to the shape of a T. The slot 35 extends perpendicularly relative to the junction gap 2 of the both adjacent panels 1 and meets the slot 34 centrally. Two flaps 36 are thus formed in the protective conductor layer 19, which flaps can be upwardly bent along bending edges 37, so that the opening 3 can be exposed together with the connecting channel 11 extending to the junction gap 2, or respectively, the corresponding covers 15, 16. These both flaps 36 are shown in their upwardly bent position in FIG. 14 and also in FIG. 13 for the upper one of both surface heating elements 1, whereas the lower surface heating element 1 of FIG. 13 shows both flaps 36 in their flat condition, in which both flaps 36 completely cover the connecting point.

If an electrical connection of the conductors 10' connected to the protective conductor layers 19 of the two panels shall be effected within the area of an opening 3, said both flaps 36 are upwardly bent within the area of this opening 3, whereupon the covers 15, 16 can be removed, so that the connecting point is exposed and the required connection of both conductors 10' can be made by means of the screw terminals 13. After having placed the covers 15, 16 in position, said both flaps 36 are again downwardly bent and optionally glued with their contacting surface onto the rigid covers 15, 16 or onto the adjacent areas of the layer 20, respectively.

Figure 16:
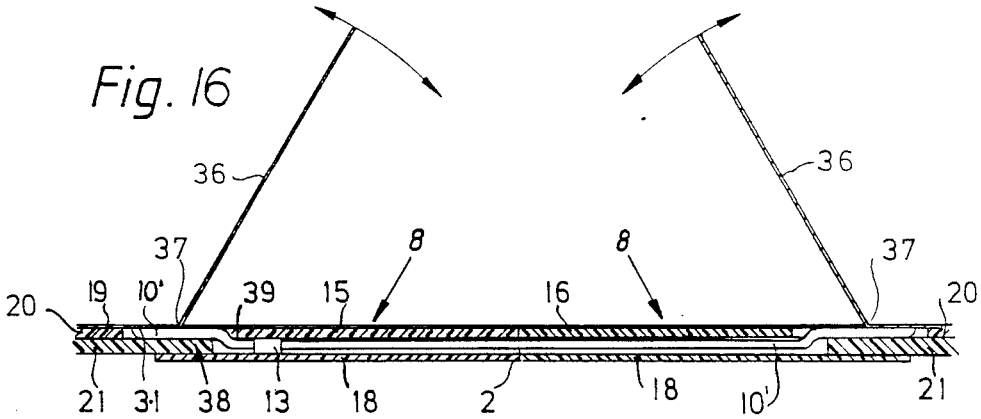
FIG. 15 shows a modified embodiment of the embodiment according to FIG. 13 in a top plan view and FIG. 16 is a section taken along the line XVI—XVI of FIG. 15.
Figure 15:
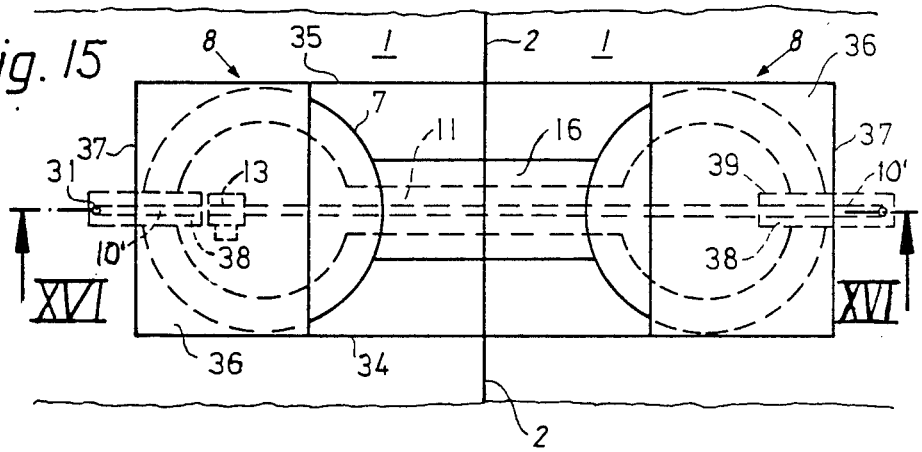

Optionally, also more or less than two slots 34, 35 or slots extending in any other manner can be provided. Further, each connecting point 8 can, in the embodiment according to the FIGS. 15 and 16, be covered by only one flap 36, which extends from the panel edge, namely from the junction gap 2 of two adjacent panels 1, and is limited by two parallel incisions or slots 34, 35 in the electrically conductive layer 19. This flap 36 can be upwardly bent into the position shown in FIG. 16 along a bending line 37 extending parallel to the junction gap 2 and interconnecting the two inner ends of the slots 34, 35, the flap 36 being optionally also adapted to the rolled up. In its downwardly swivelled position, the flap 36 completely covers the connecting point 8, namely the cavity 7 and the connecting channel 11 together with said both covers 15, 16. The conductor 10', which is connected at 31 to the protective conductor layer 19 by soldering, can be introduced into the cavity 7 of the connecting point 8 through a guide 38 having U-shaped cross section, which guide may be formed by extensions of the layers 20, 21, so that this supply conductor is reliably introduced. In this case, the cover 15 has a corresponding recess 39 at the place of the guide 38.

Figure 17:
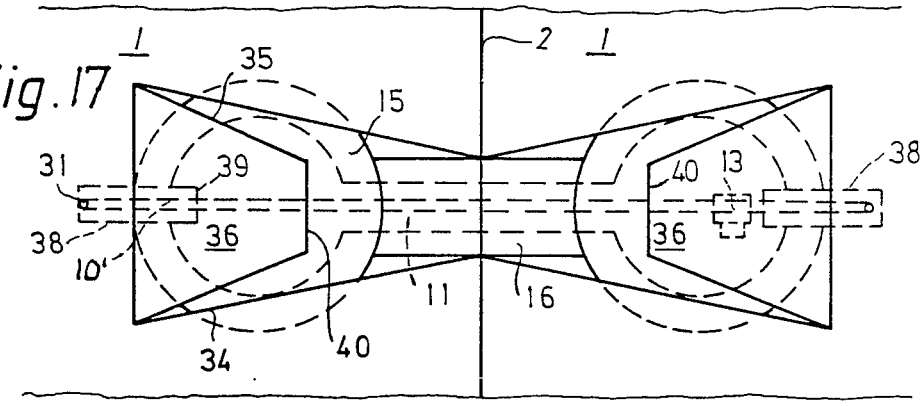
FIG. 17 shows in a top plan view a further modification of the embodiment according to FIG. 13.

The incisions delimiting the flaps need not extend parallelly but it is possible to give the incisions any desired configuration. So shows the modified embodiment according to FIG. 17 that the flaps 36 are limited by incisions 34, 35 of decreasing mutual distance in direction to the edge of the panel 1, so that each flap has the shape of a trapeze. This results in the advantage, that the front edge 40 extending along the junction gap 2 is only very short, so that a particularly reliable seat of the flap 36 pushed back onto the panel 1 is achieved. Because in this case the flap 35 does not completely clear the cover 15 in the upwardly swivelled position, the cover 15 may in such a case consist of two or more parts for being removable with greater facility.

Figure 19:
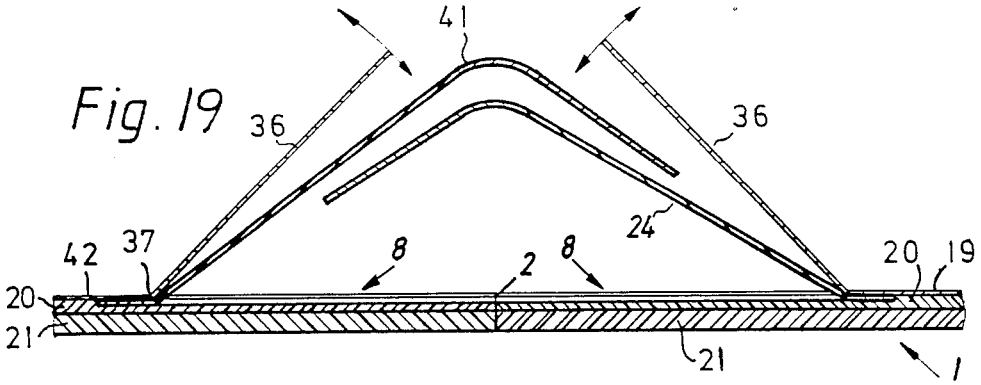
FIG. 18 shows an embodiment of the connection between protective conductive layers of adjacent panels in a top plan view and FIG. 19 is a section taken along the line XIX—XIX of FIG. 18.

In the embodiment according to the FIGS. 18 and 19 one flap 36 each is provided on each panel 1 within the area of the connecting point 8 and is, in a similar manner formed by two slots 34, 35 extending parallely in the protective conductor layer 19. However, there need not exist an opening 3 below this flap 36, but there can be provided below the flap 36 on each panel 1 a connecting element 41 having the shape of a narrow flexible strip of an electrically conductive material, such as a strip of metal sheet or a thin metal net, for connecting the protective conductor layers 19 of both panels 1. The one end 42 of this connecting element 41 is fixed by clamping within the area of the bending line 37 of the flap 36 and below the layer 19 and is connected, preferably by soldering, to the layer 19 in an electrically conductive manner. The elongated connecting element 41 extends from this end 42 in direction to the junction gap 2, but beyond the edge of the panel 1, preferably for approximately twice the length of each slot 34, 35. The connecting elements 41 of both panels 1 thus overlap one another, which facilitates the electrically conductive connection of both connecting elements 41, for example by soldering, screwing and so on. The excessive length of said both connecting elements 41 enables one to make this electrical connection at any desired location. Those portions of the connecting elements 41, which are superfluous after having made the electrical connection, are cut off. After having made the electrical connection, the remaining portions of the connecting elements 41 assume, together with the connecting point, a flat position if both flaps 36 are again pushed back into the plane of th electrically conductive layers 19 of both panels 1. For the purpose of reliably providing space for the remaining portions of both connecting elements 41, their width, measured in normal direction to the longitudinal direction of the connecting elements 41 and in horizontal direction, is smaller than the width, measured in the same direction, of each of the flaps 36. Since each connecting element 41 has an only very small thickness, it bulges both flaps 36 upwardly for an only negligible degree. Such bulging can completely be avoided if a depression is provided in the layer 20 at the connecting point 8 and below the flaps 36, said depression providing the space for both remaining parts of the connecting elements 41 as well as for their connection area, for example the solder. Optionally, the required space, if not already provided for by the cavity 7, may be provided by scraping out or grinding out those areas of the layers 20, 21, which are located below the connecting joint.

In the embodiment according to FIG. 20, a wire is used as a connecting element 41 instead of a flexible flat strip. These both wires can be connected electrically conductive one with the other, for example, by soldering, by screwing, by means of crimping shells and so on. Also in this case, it is convenient to provide corresponding depressions within the panels 1 for the wires of the connecting elements 41 as well as, optionally, for their screw connections and so on.

In the embodiment according to FIG. 21, a flat flexible strip is used in analogy to FIG. 18 as the connecting element 41 for each panel 1 and each flap 36 has the shape of a trapeze, but with the shorter parallel side as the bending edge 37.

In all embodiments, any optionally remaining cavities can be filled by a casting operation or an injection operation, respectively, with an insulating elastic compound, for example polyurethane, silikone or the like. Such procedure can also be used to fix the flap 36 by glueing subsequently to the casting or injection operation, the flap being downwardly swivelled and being downwardly pressed till the solidification of the casting or injection compound. However, instead thereof, there may also be used a suitable adhesive.

The panel 1 need not necessarily be rigid, it is, for example, possible within the spirit of the invention, to make the panels of flexible material and even elastic material, for example rubber or synthetic plastics material, which, if desired, may contain electrically conductive additives.

If a tension relief is desired for the conductors interconnecting adjacent heating elements, this can be obtained by placing also a tension-relieving material, for example a glass band or the like, into the cavities of the connecting point together with the connecting wires and by anchoring it within the cavity 7, said glass band being connected with the glass band of the opposite element, for example by knotting, glueing, clamping joints or the like. Instead of such a glass band, there may also be used a band of synthetic plastics material or a metallic tension element, noting that the latter can also be connected by screwing. Alternatively or in addition thereto, a fishplate of tension-resistant material, for example metal, can be provided on the surface of the plate within the area of the connecting point, particularly in such a manner that the fishplate extends above both covers 15 of the connection and is fixed, for example by screwing, to both elements 1. At this, the screw holes within the fishplate should be made so great that an expansion of the panels 1 during heating is possible.

Of course, each surface heating element may be equipped with at least one thermic disconnector for preventing any over-heating. Conveniently, each surface heating element has at least two heating circuits, which can be disconnected independently one from the other by means of such thermic disconnectors.

An increased degree of security against inflammation can be obtained by using a self-extinguishing material for the layers 20, 21. For this purpose, for example, polyester having incorporated aluminium hydroxyde or similar flame retarders is suitable.

Instead of this process for fixing the supporting members 18 to the panel 1 described with reference to FIG. 12, the procedure can also be such that the bottom surface of the panel 1 is made tacky by heating or by means of the actions of solvents, whereupon the plates forming the supporting members 18 are applied at the desired locations and are in commom pressed onto the panel in the manner shown in FIG. 12. If the bottom layer of the panel 1, which bottom layer has been brought into a pasty condition, is sufficiently thick, a height-equalization of all supporting members 18 can be achieved also in this manner.

The described layers 20, 21 may, as well as the supporting members 18, consist of the same synthetic plastics material, the use of liquid resins, preferably glass fibre-reinforced polyester, being particularly suitable. In this manner, it is possible to interconnect the individual layers such, that after the solidification an uniform, one-piece body of synthetic plastics material is formed in which the areas of transition between the individual layers can no more be detected.

We claim:

1. An electrical surface heating element comprising a panel of synthetic plastics material having embedded therein heating conductors and supply conductors, said panel having at least one cavity open in direction to the edge of the panel, said supply conductors entering said cavity which is adapted to accommodate electrical connection means of said supply conductors of adjacent panels, said cavity having, as seen in a top plan view on the panel, a circular portion and a constricted portion, said constricted portion connecting said circular portion with the edge of the panel and accommodating said supply conductors, said cavity extending in upward direction substantially up to the top surface of the panel also within the area of the constriction and having a step-like enlargement in direction to the top surface of the panel, said enlargement being limited by a horizontal surface portion of the cavity, said cavity being closed from above by at least one removable cover means extending to the panel edge and covering the connection means, the top surface of said cover means being substantially flush with the top surface of the adjacent panel area, said cover means being abutted on said horizontal surface portion, said cavity being closed to below by a plate means fixed to the bottom surface of the panel.

2. Surface heating element as claimed in claim 1, further comprising at least one filling compound within said cavity.

3. Surface heating element as claimed in claim 2, wherein said circular portion of the cavity is connected to the panel edge by a connecting channel being delimited by two oppositely salient protrusions forming said constricted portion of the cavity, the mutual distance of said protrusions from one another being smaller than the diameter of the circular portion.

4. Surface heating element as claimed in claim 3, wherein said circular portion and said connecting channel are closed in upward direction by separate covers.

5. Surface heating element as claimed in claim 4, wherein said circular portion of said cavity is formed by a bore.

6. Surface heating element as claimed in claim 5, wherein lateral recesses are provided in the circular portion of the cavity, which recesses receive the ends of the supply conductors and extend away from the circular portion of the cavity and are open in upward direction and in direction towards said horizontal surface portion of the cavity.

7. Surface heating element as claimed in claim 1, wherein said plate means constitutes a supporting member of the panel.

8. Surface heating element as claimed in claim 7, wherein said supporting member together with further supporting members distributed over the bottom surface of the panel forms a supporting system for the panel, said supporting system having a net of mutually interconnected air channels between the supporting members.

9. Surface heating element as claimed in claim 8, wherein the length and the width of each supporting member is only a fraction of the length and of the width of the panel.

10. Surface heating element as claimed in claim 9, wherein the width of each air channel when measured from supporting member to supporting member is greater than the length and the width of a supporting member.

11. Surface heating element as claimed in claim 10, wherein said supporting members are formed out of a bottom surface layer of the panel.

12. Surface heating element as claimed in claim 11, wherein said supporting members are formed by a deep drawing process.

13. Surface heating element as claimed in claim 11, further comprising a cross-piece provided within said cavity, both ends of said cross-piece being abutted on the side wall of the cavity, current supply wires leading to said supply conductors being wound on said cross-piece.

14. Surface heating element as claimed in claim 13, wherein guiding grooves are provided on said cross-piece for said current supply wires.

15. Surface heating element as claimed in claim 14, wherein said cross-piece is an elongated plate located in a flat position within said cavity and comprising guiding grooves obliquely extending relative to the longitudinal axis of the plate.

16. Surface heating element as claimed in claim 11, wherein an electrically conductive layer is provided on the top surface of the panel, which layer has at least one upwardly swivellable flap.

17. Surface heating element as claimed in claim 16, wherein said layer is a protective conductor layer.

18. Surface heating element as claimed in claim 16, wherein said flap is arranged above said connection means and is adapted to be upwardly swung from a position covering said connection means into a position giving free the connection means.

19. An electrical surface heating element comprising a panel of synthetic plastics material having embedded therein heating conductors and supply conductors, said panel having at least one cavity open in direction to the edge of the panel, said supply conductors entering said cavity which is adapted to accommodate electrical connection means of said supply conductors of adjacent panels, said cavity having, as seen in a top plan view on the panel, a circular portion and a constricted portion, said constricted portion connecting said circular portion with the edge of the panel and accommodating said supply conductors, said cavity extending in upward direction substantially up to the top surface of the panel also within the area of the constriction and having a step-like enlargement in direction to the top surface of the panel, said enlargement being limited by a horizontal surface portion of the cavity, said cavity being closed from above by at least one removable cover means extending to the panel edge and covering the connection means, the top surface of said cover means being substantially flush with the top surface of the adjacent panel area, said cover means being abutted on said horizontal surface portion, said cavity being closed to below by a plate means fixed to the bottom surface of the panel, said panel including an electrically conductive layer on the top surface thereof, said electrically conductive layer including at least one flap which is upwardly swivelable and extends to the edge of the panel.

20. Surface heating element as claimed in claim 19, wherein said flap is limited by two slots provided in the electrically conductive layer and extending from the edge of the panel.

21. Surface heating element as claimed in claim 20, wherein said slots extend parallelly to each other.

22. Surface heating element as claimed in claim 19, wherein two flaps are provided one adjacent the other, said flaps being separated from one another by a first slot provided in said electrically conductive layer and extending from the edge of the panel, each of said flaps being delimited by a further slot normally extending relative to the first slot.

23. A process for producing an electrical surface heating element in the shape of a panel of electrical insulating material having embedded therein heating conductors and supply conductors, comprising the steps that a first layer of the electrical insulating material is made, in which layer at least one opening is made, that a second layer of the electrical insulating material is prepared and is provided with at least one opening being smaller than said opening in the first layer but sufficiently large to accommodate electrical connection means for electrical connecting the supply conductors of two adjacent heating elements, said opening of said second layer having in its wall at least two mutually staggered recesses for accommodating said supply conductors, that then the heating conductors and supply conductors are positioned on the bottom side of said second layer, the ends of said supply conductors being positioned within said recesses, that a third layer of electrical insulating material is fixed to the bottom side of said second layer for covering the heating conductors and supply conductors and that the first and second layers are connected to each other so that their openings align with each other.

24. Process according to claim 23, wherein the openings in said first and second layers are made by a boring step.

25. Process according to claim 23, wherein said third layer is subjected to a boring operation within the area of said opening after having placed the ends of said supply conductors outwardly of the region of said opening in said second layer.

26. Process as claimed in claim 23, wherein said openings in at least said second layer are filled with a material not adhering to said supply conductors and to said first, second and third layers.

27. Process as claimed in claim 23, wherein a cover is placed in the openings of said first layer for closing the cavity formed by said openings in said first and second layers.

28. Process as claimed in claim 23, wherein a supporting member is fixed to the bottom side of said third layer so that the cavity confined by said openings in said first and second layers are closed from above, a selected plurality of said supporting members is made flush within a plane by pressing said plurality of supporting members by a plane element against a tacky layer provided on said third layer prior to the solidification of said tacky layer so that, after solidification of said tacky layer, said plurality of supporting members is rigidly immovably connected to said panel and lying with the bottom surfaces of said supporting members in a common plane.

29. Process as claimed in claim 28, wherein said plurality of supporting members is pressed against a plane ruler.

30. Process as claimed in claim 28, wherein said pressing of said plane element against said supporting members is effected until said plane element engages stop members arranged at both sides of the panel, said stop members defining the nominal height of the panel provided with said supporting members.

31. Process as claimed in claim 28, wherein said third layer is made tacky by applying an excessive layer of adhesive to said third layer.

32. Process as claimed in claim 28, wherein said third layer is made tacky by weakening its bottom surface area at least at those places where said supporting members are to be fixed.

* * * * *